US008393760B2

(12) United States Patent
Safar

(10) Patent No.: US 8,393,760 B2
(45) Date of Patent: Mar. 12, 2013

(54) FLUORESCENT LIGHT EMISSION ENHANCER LIGHT-CONE

(75) Inventor: Samir Hanna Safar, San Diego, CA (US)

(73) Assignee: Samir Hanna Safar, San Diego, CA (US)

( * ) Notice: Subject to any disclaimer, the term of this patent is extended or adjusted under 35 U.S.C. 154(b) by 179 days.

(21) Appl. No.: 13/021,874

(22) Filed: Feb. 7, 2011

(65) Prior Publication Data

US 2012/0201012 A1 Aug. 9, 2012

(51) Int. Cl.
*F21V 7/18* (2006.01)

(52) U.S. Cl. ..... 362/296.01; 362/84; 362/341

(58) Field of Classification Search ..... 362/84, 362/217.05, 296.01, 296.02, 296.05, 341
See application file for complete search history.

(56) References Cited

U.S. PATENT DOCUMENTS

| | | | | |
|---|---|---|---|---|
| 4,499,529 | A | 2/1985 | Figueroa | |
| 4,599,684 | A | 7/1986 | Lee | |
| 4,855,885 | A | 8/1989 | MacEachern et al. | |
| 5,062,030 | A | 10/1991 | Figueroa | |
| 5,274,533 | A | 12/1993 | Neary et al. | |
| 5,414,604 | A | 5/1995 | Anderson | |
| 5,988,836 | A | 11/1999 | Swarens | |
| 6,170,962 | B1 | 1/2001 | Wordin | |
| 6,667,582 | B1 | 12/2003 | Procter | |
| 7,053,540 | B2 * | 5/2006 | Bobel | 362/296.01 |
| 2004/0184269 | A1 * | 9/2004 | Walton | 362/260 |
| 2006/0092643 | A1 | 5/2006 | Wong et al. | |
| 2006/0126339 | A1 | 6/2006 | Hayes | |
| 2006/0170335 | A1 | 8/2006 | Cho et al. | |
| 2006/0262551 | A1 | 11/2006 | Fallahi et al. | |
| 2007/0262335 | A1 | 11/2007 | Kumei et al. | |
| 2009/0091935 | A1 | 4/2009 | Tsai | |
| 2009/0135606 | A1 | 5/2009 | Young | |
| 2010/0271821 | A1 | 10/2010 | Chen et al. | |

FOREIGN PATENT DOCUMENTS

WO WO 2010059078 A1 * 5/2010

* cited by examiner

*Primary Examiner* — David V Bruce

(57) ABSTRACT

A fluorescent light emission enhancer light-cone for insertion into the central aperture of the fluorescent light bulb and subsequent expansion into a cone which helps increases the light intensity of the fluorescent light bulb by emitting outside almost half of light emission from the fluorescent light bulb that is lost inside between its loped tubes.

8 Claims, 3 Drawing Sheets

FLUORESCENT LIGHT EMISSION ENHANCER LIGHT-CONE

FIELD OF THE INVENTION

The present invention relates to the field of illumination devices, particularly to an illumination enhancer. More particularly the present invention relates to a novel light-cone that is designed to be placed inside a light fluorescent bulb and can substantially enhance the emission of fluorescent light.

BACKGROUND OF THE INVENTION

Fluorescent lighting is now in common use in homes, offices, hallways, stairways and public areas for providing illumination. A fluorescent lamp converts electrical power into useful light more efficiently than an incandescent lamp. Lower energy cost typically offsets the higher initial cost of the lamp.

While larger fluorescent lamps have been mostly used in commercial or institutional buildings, the compact fluorescent lamp is now available in the same popular sizes as incandescents and is used as an energy-saving alternative in homes. These lights can be operated at greatly reduced costs when compared to incandescent lights. Also, fluorescent tubes and bulbs provide even distribution of light without glare.

Light generally shines in all directions from a light source. Thus light emitted by a fluorescent tube or bulb tends to be emitted in all directions. This type of light is that the light emitted by the bulbs is often misdirected so that it never reaches the area where the illumination is desired. Thus, when it is mounted on a ceiling, a fluorescent tube or bulb radiates light upwardly where it is wasted. This happens in several ways. For example, light emitted by a fluorescent tube or bulb may be reflected back into the same tube or bulb, or the light may not be reflected at all and simply be emitted in a direction where no illumination is desired.

Again use of more artificial illumination than required is expensive and energy-intensive. Over-illumination is the presence of lighting intensity (illuminance) beyond that required for a specified activity. Over-illumination can contribute to light pollution, where stray light illuminates the outdoors or others' property, where it is unwanted.

The reflector or enhancer had thus found favor where the choices of artificial light provided poor illumination compared to modern electric lighting. Light reflectors or enhancers have long been used to bounce light off of a reflective surface. Thus light reflectors or enhancers have successfully been used for years to provide light in a desired area. Reflectors or enhancers have been used primarily to collect the wasted light and direct it downwardly towards the area to be lighted to increase the illumination efficiency of the light source. If light shining in all directions from a light source is not useful, a reflective surface can be employed to reflect light from a direction in which it is not useful and projected towards a direction in which the light is useful. An ideal reflector or enhancer should be capable of collecting all the light emitted upwards by the source, direct it accordingly within the lateral boundaries of the area to be lighted. In this way, light reflectors or enhancers increase the amount of light shining in a desired direction.

However, the problems posed by such reflectors or enhancers known in the field are many because of several factors such as the specific geometry of the reflector body, the reflectivity of the surface of the reflectors or enhancers, ability to withstand high temperatures, costs, finishes used on the reflector surface, etc.

For example reflectors or enhancers usually employ translucent covers beneath the fluorescent tubes or bulbs to diffuse the light evenly over the area of illumination; these translucent covers absorb light, thereby hampering efficiency Again daily users of the fluorescent tube or bulb often find it difficult in procuring a ready to fit customized light reflector or enhancer. Some cannot adequately reflect the light rays emitted at high angles permitting it to exceed the lateral boundaries of the area to be lighted.

Again typical reflectors or enhancers for fluorescent tube or bulb tend to concentrate light output in a downward direction (i.e. toward the floor) and do not provide a sufficiently desirable diffuse lighting characteristic (e.g. towards sidewalls, etc.). Substantial amounts of light and energy are wasted by the reflector or enhancer due to light being directed toward areas, such as ceilings, where the light is not needed or desired. Others tend to concentrate the light to a particular section of the area, reducing the apparent uniformity of illumination of such area, thus causes glare. The misdirected light wastes electrical energy and leads to the undesired heating of the light fixture components. A significant portion of light produced by the fluorescent tube or bulb is attenuated within the housing in which it is situated, so less light is available to illuminate the area of interest. Thus users usually resort to a made-to-order light reflectors or enhancers which results in more expenditure.

Again to vary the direction of the light, these reflectors or enhancers have to be moved relative to the light source. This would require sophisticated mounting means.

Again reflective components typically emit an undesired amount of infrared light along with the desired visible light. This infrared light unduly heats the area on which the projected light is imaged. In many instances, the components of the fluorescent tube or bulb or the reflector or enhancer become damaged by the excessive heat, and therefore must be replaced.

Again the enhanced light coming out of the fluorescent tube or bulb after the effect of the reflector or enhancer can sometimes have an intensity varying radially such that unnecessary interfering patterns and shadows are projected. This results in an increased amount of misdirected light.

The relevant prior art methods, which will deal with various kinds of light enhancers, are as follows:

U.S. Pat. No. 4,499,529 (A) describes a light reflector for specific use in combination with an elongate light source such as a fluorescent lamp. It has a plurality of reflecting surfaces disposed behind and symmetrically of the light source and includes opposed central tangent reflecting surfaces. The cumulative effect of the reflecting surfaces is to synthesize the light rays emitted upwards with those emitted downwards by the source towards the area to be lighted.

U.S. Pat. No. 4,855,885 (A) claims a light beam intensifier (10) having a paraboloidal reflector (12) a mirror (14) a single light tube (16) and window (18). The mirror (14) is placed forward of the focal point f of the reflector (12) and has the light tube (16) affixed thereto to be positioned coincident with the focal point f. As the light tube (16) is energized, light rays (52) emanating directly therefrom are reflected from the parabolic reflector (12) to form a first beam path and the forward shining light rays (54) are reflected from the reflective surface (34) of the mirror (14) to be reflected off the paraboloidal reflector (12) to form a composite light beam path (56) having a predetermined pattern.

U.S. Pat. No. 4,599,684 (A) claims a reflector assembly for fabricating as part of an original light fixture or for retrofitting a light fixture in the field. First (36) and second (52) reflector structures are formed with seams (38,58) about which the various reflector surfaces can be rotated for adjustment with respect to a fluorescent tube (30). A flap (62) and tape strip (74) are accessible through doors (76) for securing the reflectors in the fixture housing (24). A third reflector (178) can also be installed. A composite reflector (188) is formed by joining the respective reflectors with two additional sections (218, 228). The preferable reflector material is cardboard over which is formed a specular surface. For hallways, a reflector structure (240) is formed for mounting reflector surfaces (250) perpendicular to the longitudinal centerline (252) of housing and tube. The foregoing reference numbers in parentheses are provided solely to facilitate quick comprehension; these numbers are not to be used for interpreting the breadth of the Invention defined by the Claims.

U.S. Pat. No. 5,062,030 (A) discloses a light reflector for specific use in combination with a lighting fixture having one or more elongate light source such as fluorescent lamp. It has a plurality of angled planar light reflecting surfaces disposed behind and symmetrically of the light source and includes a central reflecting surface. The light reflector is so dimensioned and substantially configured such that it could readily be assembled and/or fitted about in all existing fixtures. For instance, one or two reflectors could readily fit to two or four-bulb lighting fixtures, respectively.

U.S. Pat. No. 5,274,533 (A) details a reflector assembly for fluorescent luminaires. The reflector assembly improves the lumen output of the fixture by bringing light from the backside of the lamps around the lamps and out of the luminaire. Access to the ballast of the luminaire is improved by providing a removable section of the reflector assembly located over the ballast.

U.S. Pat. No. 5,414,604 (A) claims a reflector for a fluorescent fixture having an elongate generally cylindrically concave inner surface defining a cavity shaped so that all portions of a fluorescent lamp along the reflectivity axis are within the cavity. The inner surface of the reflector includes a specularly reflective major central portion that reflects a major portion of light emitted from the lamp generally normal to an imaginary plane across an outlet side of the cavity to illuminate an area beneath the fixture, and opposite reflective signal portions adjacent opposite sides of the reflector that each direct a minor portion of the light emitted by the lamp across the open side of the cavity and past the opposite edge of the inner surface to indicate to persons spaced from the illuminated area that the fluorescent lamp is emitting light.

U.S. Pat. No. 5,988,836 (A) describes an indirect fluorescent lighting fixture with a self-contained curved reflector is enclosed in a square housing that fits into an inverted T-bar grid cell of a suspended ceiling in place of 2'×2' ceiling tile, or it can be permanently mounted in a wall or ceiling. A centrally located fluorescent tube, extending between two opposite sides of the enclosure, is enclosed from view by a U shaped shield. The reflector, disposed above the tube directing light downwardly into a targeted room region, can be made with a single concave curvature for narrower "spotlight" applications or with a dual concave curvature for wider field applications. The reflector is held in place in a self-stressed condition between a pair of end channels such that its shape can be controlled by varying its length. The illumination pattern can be controlled and modified by a combination of shaping the reflector's curvature and selection of its reflective surface properties. An embodiment made with a dual concave curvature reflector surfaced with small ramp ridges provides wide angle coverage free of high angle glare, enabling uniform coverage of large areas with multiple optimally spaced fixtures.

U.S. Pat. No. 6,170,962 (B1) claims a specular dual compound reflector having a cross section in the form of hyperbolas is disclosed. This reflector is combined with energy saving fluorescent tubes and ballast, forming a fluorescent light fixture for the purpose of providing adequate and uniform illumination to a surface, subdue shadows, provide agreeable illumination, and resulting in substantial energy savings. Two similar configurations are disclosed U.S. Pat. No. 6,667,582 (B1) claims a reflector for an LED (7) having a housing (1) and front portion (10) for emitting a main beam of light, the reflector comprising a body (6) defining a cavity in which the LED (7) maybe at least partially located, the body (6) comprising: (a) at least one wall (6, 10) to substantially surround the perimeter of the housing (1), said wall (6, 10) being spaced from the housing (1); (b) a fastener (9) to releasably fasten the LED (7) at least partially in the cavity; and (c) an opening (5) to permit passage of light from the LED (7); wherein the at least one wall (10) of the body is adapted to reflect a substantial amount of incident light from the LED towards the opening (5).

US Patent Publication No: US 20060092643 (A1) describes an apparatus for collecting light from an LED and transmitting it in a near-uniform column which includes a conical reflector having a roughed up inner surface about the base of the LED for collecting light emitted to the sides of the LED, and a lens specially designed to focus the collected light into a near-collimated beam. The lens has opposite, substantially elliptical surfaces to collect and collimate the rapidly diverging light from the LED and the reflector, and each lens surface includes a flat spot to prevent shadows from forming, thereby producing a more uniform beam.

US Patent Publication No: US 20060126339 (A1) claims a reflector for a fluorescent lamp formed in an integral molded unit. The reflector has arcuate side portions which present a receptacle area for receiving a fluorescent light tube. The side portions are joined together by a plurality of u-shaped cross braces which extend between the side portions at spaced locations along their length. Each of the cross braces is formed by two intersecting planar surfaces which extend at acute angles relative to a common plane a the point of intersection. The result is less light loss through diffusion, improved reflectivity.

US Patent Publication No: US 20060170335 (A1) describes an LED device having a diffuse reflective surface which includes an LED chip emitting light, a reflector cup having the LED chip arranged at a bottom surface thereof and having an angled surface which diffusely reflects the light emitted by the LED chip, and a light conversion material provided in the reflector cup for converting the light emitted by the LED chip into visible light rays. The light-conversion material is spatially separated from the LED chip by a length equal or greater than the maximum length of the LED chip.

US Patent Publication No: US 20060262551 (A1) discloses a light assembly and reflector for redirecting light from a light source in a motor vehicle. The reflector generally includes a first parabolic trough, a second parabolic trough, and third trough. The first and second parabolic troughs define first and second trough axes. The third trough has a third trough axis. The first and second parabolic troughs are positioned on opposing sides of the third trough, and the first and second trough axes are angled relative to the third trough axis. In this manner, the reflector collects and reflects a sufficient amount of light while providing control over the beam pattern spread, particularly in the horizontal direction, whereby a single LED may be employed such that constraints imposed by heat dissipation are significantly reduced.

US Patent Publication No: US 20070262335 (A1) claims a light emitting device which has a reflector having a reflection surface made of porous alumina having an apparent density of 2.5 to 3.3 g/cm<3>, and an LED disposed on the reflection surface or near the reflection surface. There are provided: a light emitting device equipped with an LED chip and a reflector having a high reflectivity relative to near infrared to ultraviolet rays irradiated from an LED chip and fluorescent material; and the reflector.

US Patent Publication No: US 20090091935 (A1) describes a light fixture with an optical reflection structure, comprising a lamp housing having at least one open accommodating space for light beam to be emitted outward therefrom; a plurality of connectors for coupling a light tube to the light fixture, the connectors being located at both opposite ends in a longitudinal direction of the accommodating space; a reflector having a curved surface affixed with a composite mirror film for light reflection, the reflector being located in the accommodating space and substantially covering at least a part of a surface of the accommodating space, wherein the curved surface is determined based on law of reflection by optimizing a luminous flux of primary reflection light reflected off the reflector to the extent of 90% or more compared with a naked light source from the light tube. The light fixture of the invention provides sufficient illumination and prolongs the lifespan of the light tube in a cost-economic way, thus directly saving energy and reducing the production of carbon.

US Patent Publication No: US 20090135606 (A1) describes a multi-reflector mechanism for a LED light source which comprises a LED light source, an outer parabolic reflector, an inner parabolic reflector and a sliding switch, wherein the inner reflector is disposed within the outer reflector with the focuses of both reflectors being different points on a common axis, and the focus of the outer reflector being the highest one nearest to the plane of the opening of the outer reflector; and the LED light source is disposed within the inner reflector and protrudes out from the vertex of the inner reflector and is coaxially and adjustably disposed at or near the focus of the inner reflector or of the outer reflector, and the light emitting angle of the LED light source is larger than the angle formed by the two points on the edge of the opening forming the diameter thereof and the focus of the inner reflector. The present invention can emit a bright, sharp and wide spot of light at a shorter distance and, as an alternative by means of a sliding switch, a bright, sharp and small spot of light at a farther distance.

US Patent Publication No: US 20100271821 (A1) describes an LED light-emitting unit comprises an LED element having an optical axis and a reflector covering the LED element. The reflector comprises a light-reflecting unit recessed downwardly from a top surface of a top wall of the reflector and located corresponding to the LED element. The light-reflecting unit has a reflecting face comprising two curved faces intersecting with each other at two lines. The curved faces have axes intersecting with each other. A distance between two intersecting points of the two lines with a cross section of the reflector which is parallel to the top surface of the top wall of the reflector is larger than that between any other two intersecting points of the reflecting face intersecting with the cross section of the reflector.

However the purpose and methodology of all the above inventions that are part of prior art do not envisage the unique embodiment of a light enhancer that is highly efficient, inexpensive, very convenient to use and made of noninflammable and heat resistant material.

Accordingly, improvements are needed in the existing methods and structures that negate the above shortcomings. Thus it is desirable to provide an improved light enhancer which can be manufactured relatively quickly and inexpensively and which can be conveniently used with a fluorescent tube or bulb. The light enhancer should be able to reduce misdirected and absorbed light and provide enhanced light and eliminate unnecessary heat.

The configuration in the present invention addresses these shortcomings in the prior art by providing a novel light-cone that can enhance the emission of fluorescent light from a light bulb. The present invention is designed to be placed inside a light fluorescent bulb and thus provides for a light-cone light enhancer that can effectively enhance the light output while retaining cost efficiency.

Further it will be apparent to those skilled in the art that the objects of this invention have been achieved by providing a light-cone light enhancer that can enhance the emission of fluorescent light from a light bulb. Various changes may be made in and without departing from the concept of the invention. Further, features of some stages disclosed in this application may be employed with features of other stages. Therefore, the scope of the invention is to be determined by the terminology of the following description and claims, and the legal equivalents thereof.

SUMMARY OF THE INVENTION

This present invention may be summarized, at least in part, with reference to its objects.

The foremost object of the present invention is to provide a novel light-cone that can enhance the emission of fluorescent light from a light bulb.

Another object of the present invention is to provide a light-cone light enhancer that can be made relatively easily and inexpensively.

Another object of the present invention is to provide a light-cone light enhancer which can be conveniently used in an unobtrusive manner with a fluorescent tube or bulb.

Another object of the present invention is to provide a light-cone light enhancer that reduces misdirected and absorbed light.

A further object of the present invention is to provide a light-cone light enhancer that eliminates unnecessary heat during the light enhancing process.

Additional objects and embodiments of the invention will be set forth in part in the description which follows, and in part will become apparent to those skilled in the art upon examination of the following, or may be learned by practice of the invention. These and other objects and advantages and features of the present invention will be more readily apparent when considered in reference to the following description and when taken in conjunction below.

DETAILED DESCRIPTION OF THE INVENTION

Figure 1:
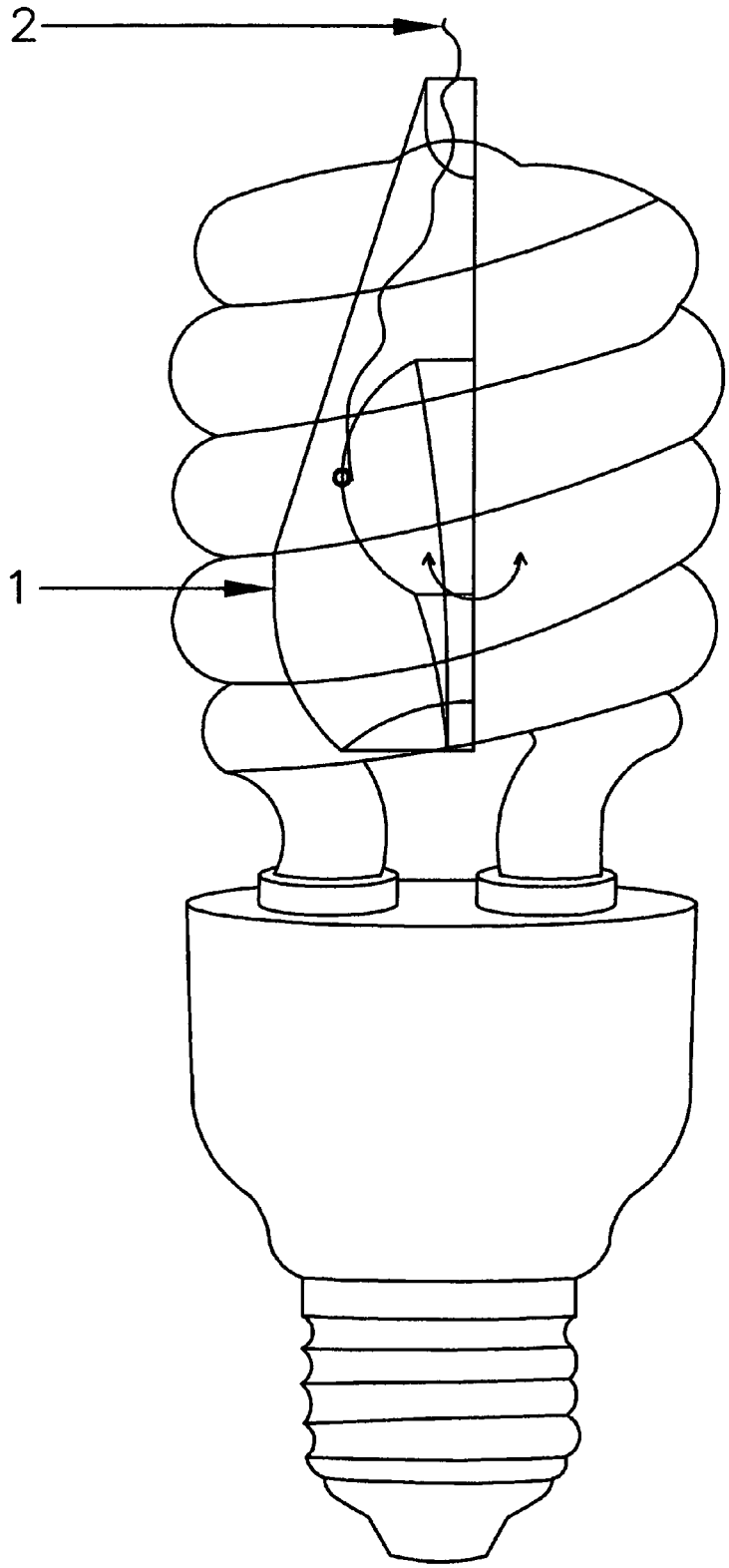
FIG. 1 is a side view of the present invention wherein the folded light-cone is fully inserted into the fluorescent light bulb.

The following description is presented to enable any person skilled in the art to make and use the invention, and is provided in the context of particular applications of the invention and their requirements. The present invention can be configured as follows:

As detailed in FIG. 1, the present invention is a light-cone (1) that is flat and can be shaped into a conical configuration. The light-cone (1) is preferably made of non-flammable material and a high reflective surface material on the outside of the light-cone (1) including but not limited to aluminum.

Figure 2:
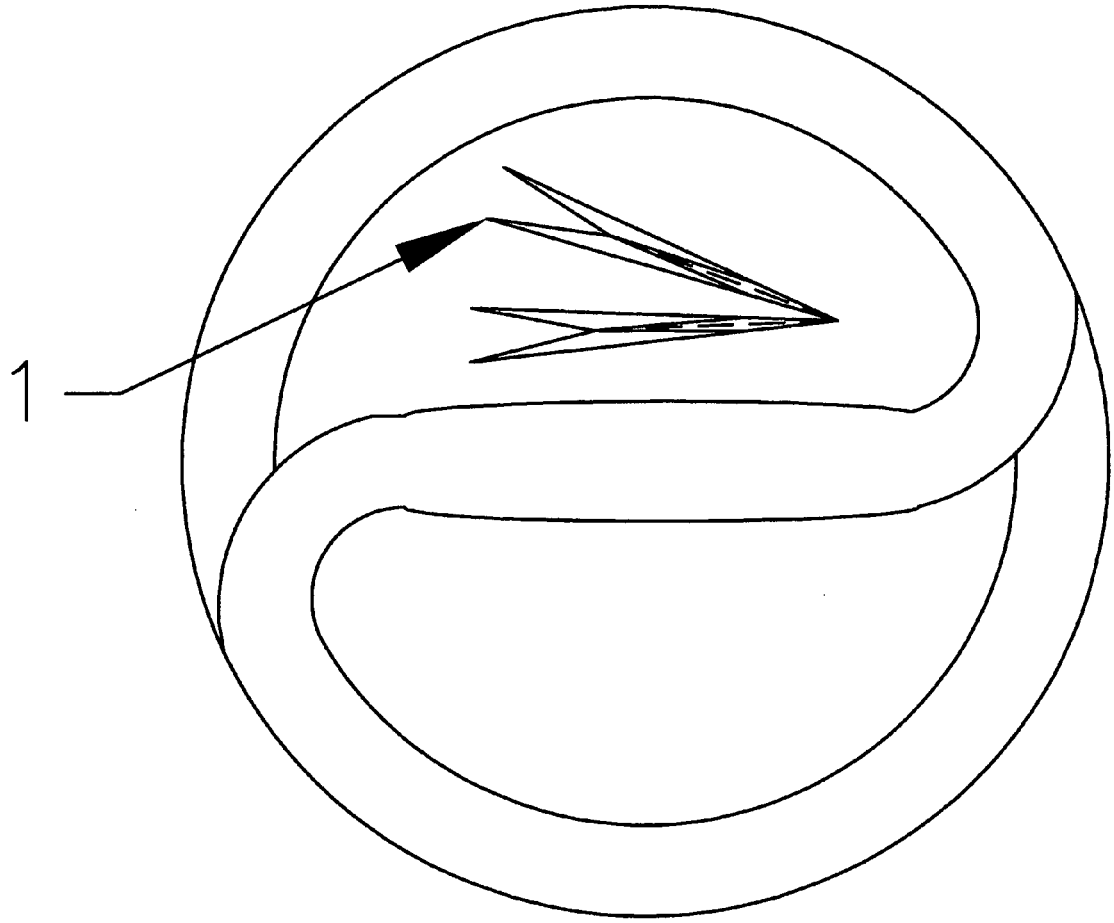
FIG. 2 is a top view of the present invention wherein the folded light-cone is fully inserted into the fluorescent light bulb.

In a preferred embodiment of the present invention, as illustrated in FIGS. 1 and 2 a flat square or rectangular or triangular or circular piece of material is manually folded for insertion into the central aperture of the fluorescent light bulb. The light-cone (1) can be the shape of the funnel too. The present invention is thus designed to be placed inside a light fluorescent bulb.

Figure 3:
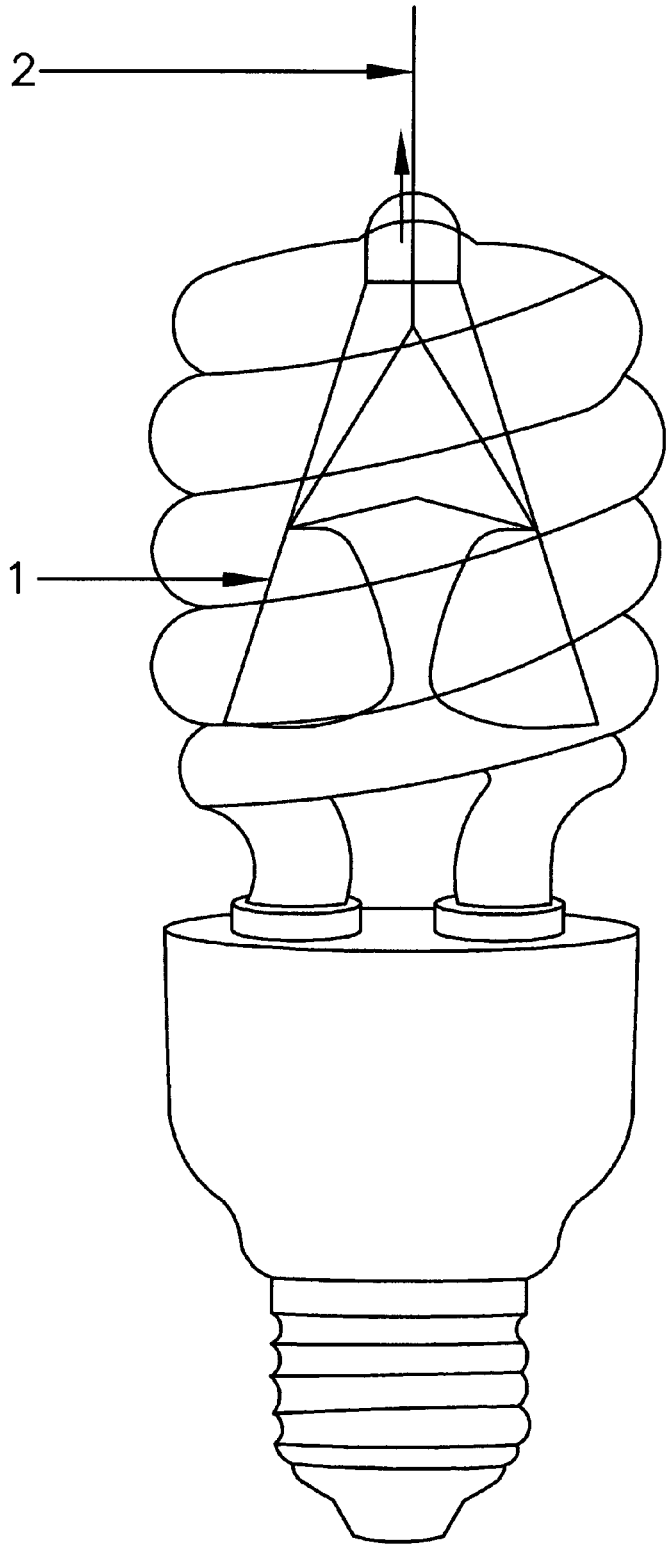
FIG. 3 is a side view of the present invention wherein the folded light-cone is fully opened inside the fluorescent light bulb.

In a preferred embodiment of the present invention, after insertion into the central aperture of the fluorescent light bulb, the light-cone (1) can be manually expanded like a box to form a conical shape. As depicted in FIGS. 1 and 2, the light-cone (1) is thus inserted in a folded configuration into the central aperture of the fluorescent light bulb and can be expanded with one pull, wherein the user pulls the thread (2) attached to the light-cone (1) which causes the light-cone (1) to fully open as depicted in FIG. 3 and be secured inside the fluorescent light bulb. When the user fully pulls the thread (2), the thread (2) gets separated from the light-cone (1).

The flaps of the light-cone (1) thus folds to be inserted inside the fluorescent light bulb such that it is stable and snuggly fits into the central aperture of the fluorescent light bulb. The light-cone (1) is thus not displaced from its position with the fluorescent light bulb.

In a preferred embodiment of the present invention, once the fluorescent light bulb is switched on, almost half of light emission from the fluorescent light bulb that is emitted to the inside of the bulb, between the loped tubes of the light of the fluorescent light bulb, falls on the light-cone (1) and is emitted to the outside of the bulb, thus enhancing the already existing light.

The present invention helps increases the light intensity of the fluorescent light bulb substantially.

In this application, the terminology 'embodiment' can be used to describe any aspect, feature, process or step, any combination thereof, and/or any portion thereof, etc. While the invention has been described in connection with specific embodiments thereof, it will be understood that it is capable of further modifications and this application is intended to cover any variations, uses or adaptations of the invention following, in general, the principles of the invention and including such departures from the present disclosure come within known or customary practice within the art to which the invention pertains and may be applied to the essential features herein before set forth.

Further it will be apparent to those skilled in the art that the objects of this invention have been achieved by providing the above invention. However various changes may be made in the structure of the invention without departing from the concept of the invention. Therefore, the scope of the invention is to be determined by the terminology of the above description and the legal equivalents thereof.

Various modifications to the disclosed embodiments will be readily apparent to those skilled in the art and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

I claim:

1. A fluorescent light emission enhancer light-cone comprising of a flat square or rectangular or triangular or circular piece that can be shaped into a conical configuration characterized in that said light-cone is manually folded for insertion into the central aperture of the fluorescent light bulb and can be manually expanded like a box to form a conical shape.

2. The light-cone as claimed in claim 1 wherein the flaps of the light-cone folds to be inserted inside said fluorescent light bulb.

3. The light-cone as claimed in claim 1 wherein said light-cone can be expanded with one pull, wherein the user pulls the thread attached to the light-cone which causes the light-cone to fully open and be secured inside the fluorescent light bulb.

4. The light-cone as claimed in claim 1 wherein when the user fully pulls the thread, the thread gets separated from the light-cone.

5. The light-cone as claimed in claim 1 wherein said light-cone is preferably made of non-flammable material.

6. The light-cone as claimed in claim 1 wherein said light-cone has a high reflective surface material on the outside.

7. The light-cone as claimed in claim 1 wherein once said fluorescent light bulb is switched on, almost half of light emission from said fluorescent light bulb that is emitted to the inside of said bulb, between its loped tubes, falls on said light-cone and is emitted to the outside of said bulb.

8. The light-cone as claimed in claim 1 wherein said light-cone increases the light intensity of said fluorescent light bulb substantially, thread, the thread gets separated from the light-cone.

* * * * *